United States Patent [19]

Aoki et al.

[11] 4,139,928

[45] Feb. 20, 1979

[54] SLIDER FOR SLIDE FASTENERS

[75] Inventors: Tsunetaka Aoki, Kamiichi; Ichiro Terasaki, Uozu, both of Japan

[73] Assignee: Yoshida Kogyo K K, Tokyo, Japan

[21] Appl. No.: 894,578

[22] Filed: Apr. 7, 1978

[30] Foreign Application Priority Data

Apr. 14, 1977 [JP] Japan ..... 52/46853[U]
Dec. 29, 1977 [JP] Japan ..... 52/176718[U]

[51] Int. Cl.[2] ..... A44B 19/30
[52] U.S. Cl. ..... 24/205.14 R
[58] Field of Search ..... 24/205.14 R

[56] References Cited

U.S. PATENT DOCUMENTS 2,299,133 10/1942 Epes ..... 24/205.14 R
2,654,931 10/1953 Voity ..... 24/205.14 R

*Primary Examiner*—Bernard A. Gelak
*Attorney, Agent, or Firm*—Bucknam and Archer

[57] ABSTRACT

A slider for slide fasteners has a retaining member mounted on the slider body and having at one end a downwardly extending anchoring portion including a reduced neck and shoulders on opposite ends thereof, defining therebetween a pair of clamping recesses, and at the other end a vertically directed head. The upper shield of the slider body has a support lug and an aperture lying beneath the lug and engaging the head of the retaining member, the slider body having a vertical clamping groove defined by outwardly diverging side walls and a flat vertical end wall of the stock of the diamond of the slider body. The end wall is centrally vertically separated by a V-shaped recess and has a pair of horizontally projecting clamping lugs dimensioned to fit in the clamping recesses in the retaining member. The anchoring portion is clamped in the clamping groove between the side walls by pressure applied transversely from opposite directions to direct the side walls toward each other over the clamping lugs which are in turn beaded over the reduced neck of the retaining member.

6 Claims, 12 Drawing Figures

SLIDER FOR SLIDE FASTENERS

BACKGROUND OF THE INVENTION

1. Field of the Invention

This invention related to sliders for slide fasteners.

2. Prior Art

A wide variety of sliders have been proposed and used. They are largely classified into "lock" and "non-lock" types. Some have been satisfactory and others unsatisfactory for different reasons.

The basic and critical reasons that most of such known sliders have been found unsatisfactory, sometimes even defective, are that a retaining member which supports a pull member pivotally on the slider body is mounted in improper position or posture, or secured with lack of firmness with the results that the retaining member is displaced or detached from the slider body or the pull member when the latter is subjected to severe pull or twist. This situation is more critical with a slider construction wherein the retaining member is utilized to serve as a locking member, as above noted, the locking projection formed on a free end of the retaining member would become shifted out of the correct path of its movement into and out of the slider channel through an aperture in the slider body and consequently get jammed in the aperture, making the slider inoperative.

SUMMARY OF THE INVENTION

With the foregoing difficulties of the prior art in view, the present invention has a primary object to provide an improved slider for slide fasteners which is string in construction and reliable in operation.

A more specific object of the invention is to provide an improved slider having means of maintaining a retaining member and its associated pull member in proper position on the slider body against displacement or detachment with respect to the slider body.

According to the invention, a slider for slide fasteners has a retaining member mounted on the slider body and having at one end a downwardly extending anchoring portion including a reduced neck and shoulders on opposite ends thereof, defining therebetween a pair of clamping recesses, and at the other end a vertically directed head. The upper shield of the slider body has a support lug and an aperture lying beneath the lug and engaging the head of the retaining member, the slider body having a vertical clamping groove defined by outwardly diverging side walls and a flat vertical end wall of the stock of the diamond of the slider body. The end wall is centrally vertically separated by a V-shaped recess and has a pair of horizontally projecting clamping lugs dimensioned to fit in the clamping recesses in the retaining member. The anchoring portion is clamped in the clamping groove between the side walls by pressure applied transversely from opposite directions to direct the side walls toward each other over the clamping lugs which are in turn beaded over the reduced nock of the retaining member.

The above objects and other features of the invention will be better understood from the following description taken with reference to the accompanying drawings which illustrate by way of example certain preferred embodiments which the invention may assume in practice.

BRIEF DESCRIPTION OF THE DRAWINGS

Like reference numerals refer to like and corresponding parts throughout the various views of the drawings and are intended to identify the form and function of such common parts unless otherwise specifically noted.

DETAILED DESCRIPTION OF THE PREFERRED EMBODIMENTS

Figure 1:
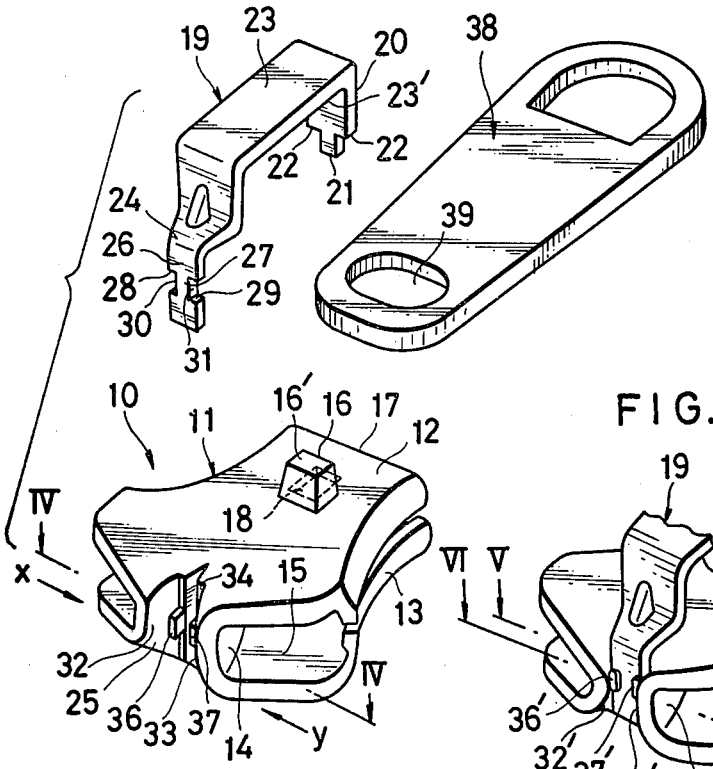
FIG. 1 is an exploded perspective view of a non-lock slider provided in accordance with the invention.

Referring now to the drawings and FIG. 1 in particular, there is shown a non-lock slider generally designated at 10 which comprises a slider body 11 constituted by a flanged upper shield 12 and a flanged lower shield 13. The upper and lower shields 12, 13 are joined at one of their respective ends by a neck or diamond 14 and disposed in parallel spaced-apart relationship so as to provide a substantially Y-shaped channel 15 for the passage therethrough of fastener stringers (not shown). The upper shield 12 is provided with a box-like support lug 16 adjacent the rear end 17 of the slider 10 and an aperture 18 which is formed to lie beneath the lug 16 conveniently by striking up the support lug 16 from the material of the upper shield 12.

A retaining member 19, which is in the form of a bail, has a rear end portion 20 directed substantially perpendicularly to the plane of the upper shield 12 and reduced in width to form a downwardly projecting head 21 with shoulders 22 on opposite sides thereof. The head 21 is substantially equal in width to the aperture 18 and has a projecting length substantially equal to the thickness of the upper shield 12. In pre-assembled or set position of the slider 10, the shoulders 22 bear flat against the outer surface of the upper shield 12.

The retaining bail 19 has a straight intermediate poetion 23 which is disposed partially as at 23' in abutting relation to the flat top surface 16' of the lug 16 when the slider 10 is assembled. Contiguous to and downwardly extending from the intermediate poetion 23 in opposite relation to the rear end portion 20 of the retaining bail 19 is an anchoring portion 24 which is adapted to be inserted into and fixedly retained in a clamping groove 25 formed in the front end of the slider 10 where the diamond 14 is situated.

The anchoring portion 24 of the retaining bail 19 has an elongated vertical portion 26 which has a length substantially equal to the height of the slider body at the front end. The vertical portion 26 consists of a reduced neck 27, and upper and lower shoulders 28, 29 on opposite ends thereof, defining therebetween a pair of clamping recesses 30, 31.

Figure 4:
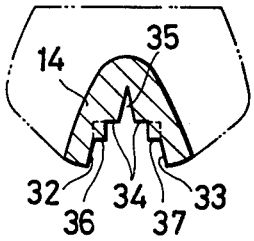
FIGS. 4, 5 and 6 are cross-sectional views taken on the line IV—IV of FIG. 1, the line V—V of FIG. 2 and the line VI—VI of FIG. 2, respectively.

The groove 25 of the slider body 11 extends perpendicularly to the plane of the shields 12, 13 and opens forwardly as shown. The groove 25 is adapted to receive the anchoring portion 24, more specifically the vertical portion 26 of the latter, for which purpose the groove 25 is generally complimentary in shape to the anchoring portion 24 of the bail 19. As better shown in FIG. 4, the groove 25 is defined by outwardly diverging side walls 32, 33 and a flat vertical end wall 34 of the stock of the slider body, the end wall 34 being centrally vertically separated by a V-shaped auxiliary recess 35 which is provided for purposes hereafter described. Projecting horizontally from the end wall 34 on opposite sides of the V-recess 35 are a pair of clamping lugs 36, 37 which are dimensioned to fit in the clamping recesses 30, 31, respectively, of the retaining bail 19 and extends beyond the thickness of the reduced neck 27 for purposes hereafter described.

Designated at 38 is a pull member or tab which has an oblong aperture 39 for engagement with the support lug 16 on the upper shield 12 and the rear end portion 20 of the bail 19 to permit the pull member 38 to be pivotal in a known manner.

Figure 2:
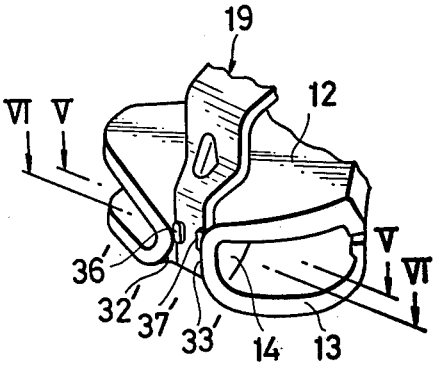
FIG. 2 is a perspective view of the slider body shown in FIG. 1 with portions taken away.
Figure 5:
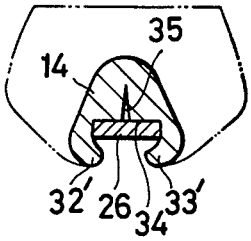
Figure 6:
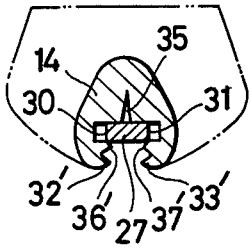

In assembling the above-described parts of the slider 10, the vertical anchoring portion 24 of the retaining bail 19 is inserted into the groove 25, with the clamping lugs 36, 37 fitted in the clamping recesses 30, 31, respectively and with the upper and lower shoulders 28, 29 held in abutting relation to the side walls 32, 33 and the flat end wall 34. In such position pressure is applied to the diamond 14 transversely from opposite directions as indicated by the arrows x and y, respectively, so as to clamp the vertical anchoring portion 24 firmly in place within the groove 25. Clamping is effected until the open ends 32', 33' of the respective side walls 32, 33 are directed inwardly toward each other over extensions 36', 37' of the respective lugs 36, 37 which are in turn beaded over the reduced neck 27 of the retaining bail 19 as better shown in FIG. 2. This clamping operation is facilitated by the provision of the V-shaped auxiliary recess 35 which converges progressively with the extent of clamping pressure applied, as shown in FIGS. 5 and 6.

With the anchoring portion 24 at the front end of the retaining lug 19 thus secured in place, the rear end portion 20 thereof is now secured to the slider body 11 together with the pull tab 38.

Figure 3:
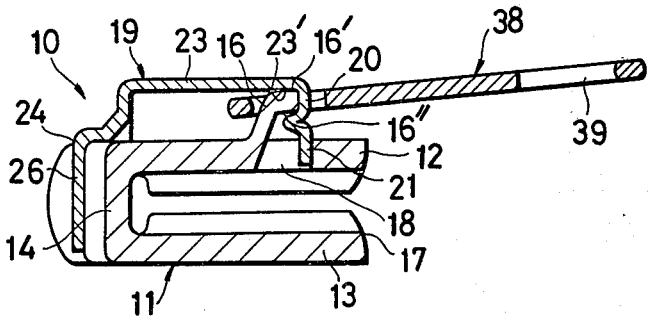
FIG. 3 is a longitudinal cross-sectional view of the slider of FIG. 1 shown assembled.

The rear end portion 20 of the bail 19 is projected through the oblong aperture 39 of the pull tab 38 laid flat over the upper shield 12, and the downwardly projecting head 21 inserted into the aperture 18 in the upper shield 12, in which position the lower surface 23 of the intermediate poetion 23 adjacent the rear end portion 20 is borne against the top surface 16' of the box-like support lug 16. In this set position, the rear end portion 20 of the bail 19 is pressed inwardly so that a part of this portion is urged into abutting engagement with a bottom surface 16'' of the lug 16 thereby firmly securing the rear end of the bail 19 to the slider body 11, as shown in FIG. 3.

The above slider construction ensures a film permanent connection of the retaining bail 19 with respect to the slider body 11 and the pull tab 38; that is, engagement of the clamping lugs 36, 37 on the front end of the slider body 11 with the clamping recesses 30, 31 prevents vertical displacement of the bail 19, while clamped or beaded lug portions 36', 37' together with clamped or beaded side wall portions 32', 33' eliminates horizontal displacement of the bail 19. Furthermore, the rear end portion 20 of the bail 19 is likewise anchored in place against displacement, with the head neck 21 fixedly engaged in the aperture 18 in the upper shield 12 of the slider body 11, as above described.

Figure 7:
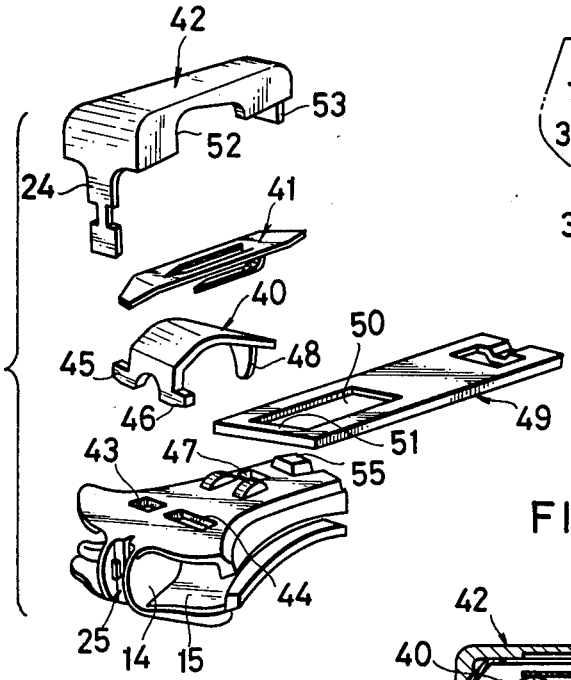
FIG. 7 is an exploded perspective view of an automatic lock slider to which the principle of the invention is applied.
Figure 8:
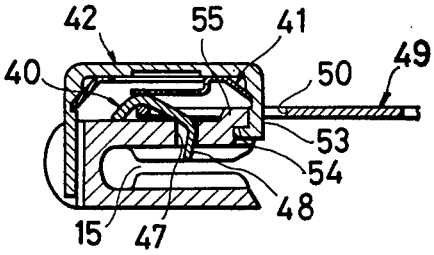
FIG. 8 is a longitudinal cross-sectional view of the slider of FIG. 7 shown assembled.
Figure 9:
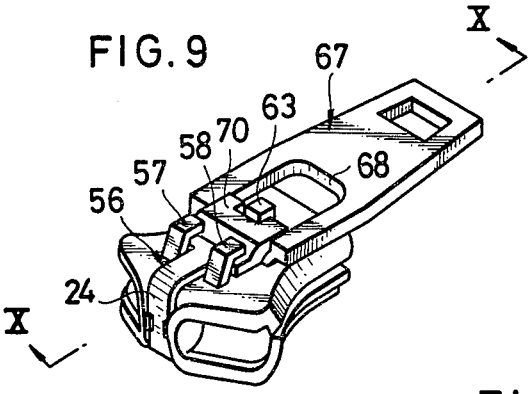
FIG. 9 is a perspective view of another form of automatic lock slider embodying the invention.
Figure 10:
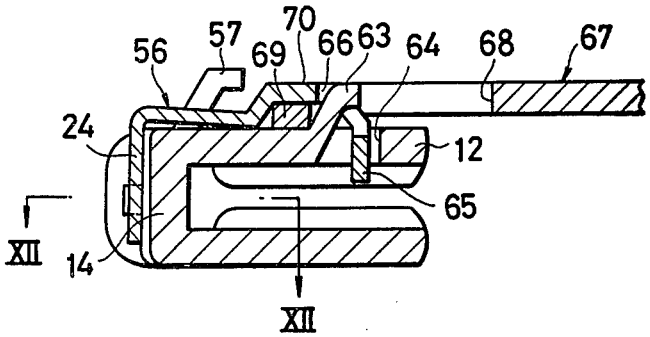
FIG. 10 is a longitudinal cross-sectional view taken on the line X—X of FIG. 9.

Reference now to FIGS. 7 and 8 shows an automatic lock type of slider 10 to which the principle of the invention is applied. In this embodiment, there are provided two additional operative parts; i.e., a locking member 40 and a spring member 41, the function of both being well known, There is shown a retaining member 42 in the form of a cap-like yoke corresponding in function to the retaining bail 19 shown in FIG. 2. The yoke 42 has at one end a vertical anchoring portion 24 which is substantially identical to that of the retaining bail 19 and which is adapted to engage in a groove 25 in the diamond 14 of the slider body 11 in the manner already described.

As shown in FIG. 7, the upper shield 12 of the slider 10 is provided with a pair of laterally spaced apertures 43, 44 adjacent the diamond 14 for receiving a pair of laterally projecting ears 45, 46 of the locking member 40 and an opening 47 adjacent the rear end of the slider adapted for a locking prong 48 to move therethrough into and out of the slider channel 15 as the locking member 40 is actuated by a pull tab 49 in a manner well known in the art. The pull tab 49 has a rectangular aperture 50 and a pivotal end 51 adapted to hinge in an opening 52 formed in and extending laterally of the yoke 42. In assembled position of the slider 10 as shown in FIG. 8, the pull tab 49 is laid over the upper shield 12, and the locking member 40 is disposed with its ear portions 45, 46 fitted into the apertures 43, 44, respectively, in the upper shield 12 and with its locking prong 48 extending through the aperture 50 of the pull tab 49 into the opening 47 in the upper shield 12 adjacent the rear end of the slider 10. Interposed between the locking member 40 and the retaining yoke 42 is the spring member 41 which normally urges the locking member 40 downwardly towards the upper shield 12 of the slider 10 so as to bring the locking prong 48 into engagement with the fastener elements in the slider channel 15 when the pull tab 49 is held flat against the upper shield 12. Lifting the pull tab 49 pivotally about its pivotal end 51 retracts the locking prong 48 from the slider channel 15 against the bias of the spring member 41. This is all well known in the art.

An important feature of the second embodiment shown in FIGS. 7 and 8 resides in the manner of anchoring the rear end of the retaining yoke 42 in place with respect to the slider body 11 in which a retaining lug 53 projecting downwardly from the rear end of the yoke 42 is bent or clinched over an extremity of the rear end of the upper shield 12 and inwardly into a recess 54 which is formed in the lower surface of the upper shield 12 by striking up the material of the latter as at 55.

Referring to FIGS. 9 through 12, inclusive, there is shown another modification, hereafter referred to as a third embodiment, of the invention which is directed to an automatic lock slider of the type having a retaining member comprising a combination bail and locking member which has a dual function; namely, to retain the pull tab in position on the slider body and to releasably lock the slider on the fastener stringers. The combination bail and locking member designeted at 56 has a vertical anchoring portion 24 which is substantially identical to that of the retaining bail 19 in the first embodiment and that of the retaining yoke 42 in the second embodiment and which is similarly adapted to engage in a groove 25 in the manner previously described.

Figure 11:
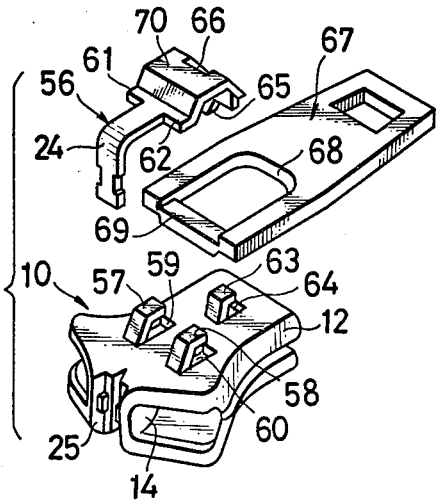
FIG. 11 is an exploded perspective view of the slider of FIG. 9, better illustrating the relationship of the various parts thereof.
Figure 12:
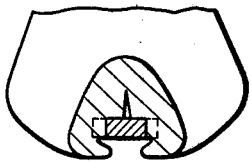
FIG. 12 is a cross-sectional view taken on the line XII—XII of FIG. 10.

As better shown in FIG. 11, the upper shield 12 of the slider 10 is provided adjacent the diamond 14 with a pair of laterally spaced, hook-like support lugs 57, 58 which are struck up from the material of the upper shield 12 to project upwardly with resultant openings 59, 60 and which are adapted to receive a pair of shoulders 61, 62 formed on opposite sides of the anchoring portion 24 of the combination bail and locking member 56. The upper shield 12 is also provided with a single support lug 63 similar to the lugs 57, 58 which is struck up from the material of the upper shield 12 adjacent the rear end of the slider 10 with resultant opening 64 adapted to receive therein a locking projection or prong 65 formed at the rear end of the combination bail and locking member 56. The member 56 has an opening 66 adjacent the prong 65 for receiving the upwardly projecting support lug 63 on the upper shield 12 of the slider 10.

A pull tab 67 in the third embodiment has an opening 68 and a trunnion-like pivotal end 69 which is adapted to engage the lower surface of a stem portion 70 of the member 56 and about which the pull tab 67 is pivotable. The pivotal end 69 is off-set so that the upper surface of the stem portion 70 of the member 56 lies substantially flush with the upper surface of the pull tab 67 when the latter is held in the horizontal position in which the slider 10 is locked.

The general construction of this automatic lock slider is well known, and hence description of further details thereof will not be required. It suffices to embody the principle of the invention in such known sliders in which the combination bail and locking member 56 is securely anchored to the front end of the slider body 11 by means of the anchoring portion 24 on the member 56 of the slider body 11 in the manner elaborated in connection with the first embodiment shown in FIGS. 1 through 6.

Such firm and robust joint between the member 56 and the slider body 11 can maintain the locking prong 65 at the free end of the member 56 in a proper position and posture such that the locking prong 65 moves unobstructively through the opening 64 in the upper shield channel 15 when the pull tab 67 is manipulated in the usual manner to lock and unlock the slider 10 on the fastener stringers.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A slider for slide fasteners which comprises:

(a) a slider body constituted by upper and lower shields, said shields being joined at one of their respective ends by a diamond and disposed in parallel spaced-apart relationship so as to define with said diamond a channel for the passage of fastener elements;

(b) a retaining member mounted on said slider body and having at one end a downwardly extending anchoring portion including a reduced neck and shoulders on opposite ends thereof, difining therebetween a pair of clamping recesses, and at the other end a vertically directed head; and (c) a pull member pivotally connected between said upper shield and said retaining member, said upper shield having a support lug and an aperture lying beneath said lug and engaging said head, said slider body having a vertical clamping groove defined by outwardly diverging side walls and a flat vertical end wall of the stock of said diamond, said end wall being centrally vertically separated by a V-shaped recess and having a pair of horizontally projecting clamping lugs dimensioned to fit in said clamping recesses in said retaining member, and said anchoring portion being clamped in said clamping groove between said side walls by pressure applied transversely from opposite directions to direct said side walls toward each other over said clamping lugs which are in turn beaded over said reduced neck of said retaining member.

2. A slider as claimed in claim 1 wherein said vertically directed head is pressed inwardly so that a portion of said head is urged into abutting engagement with said support lug.

3. A slider as claimed in claim 1 wherein said retaining member is in the form of a bail.

4. A slider as claimed in claim 1 wherein said vertically directed head is a locking prong adapted to move through an aperture in the upper shield into and out of the slider channel.

5. A slider as claimed in claim 1 further including a locking member interposed between said pull member and said retaining member.

6. A slider as claimed in claim 1, wherein said clamping lugs extending beyond the thickness of said reduced neck.

* * * * *